US010827296B2

(12) United States Patent
Eronen et al.

(10) Patent No.: US 10,827,296 B2
(45) Date of Patent: Nov. 3, 2020

(54) SWITCHING RENDERING MODE BASED ON LOCATION DATA

(71) Applicant: Nokia Technologies Oy, Espoo (FI)

(72) Inventors: Antti Johannes Eronen, Tampere (FI); Arto Juhani Lehtiniemi, Lempaala (FI); Sujeet Shyamsundar Mate, Tampere (FI); Jussi Artturi Leppanen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/612,263

(22) PCT Filed: May 30, 2018

(86) PCT No.: PCT/FI2018/050408
§ 371 (c)(1),
(2) Date: Nov. 8, 2019

(87) PCT Pub. No.: WO2018/220278
PCT Pub. Date: Dec. 6, 2018

(65) Prior Publication Data

US 2020/0068335 A1 Feb. 27, 2020

(30) Foreign Application Priority Data

Jun. 2, 2017 (EP) ..... 17174239

(51) Int. Cl.
*H04R 25/00* (2006.01)
*H04R 5/02* (2006.01)
(Continued)

(52) U.S. Cl.
CPC ..... *H04S 7/304* (2013.01); *H04R 5/033* (2013.01); *H04R 5/04* (2013.01); *H04S 1/007* (2013.01);
(Continued)

(58) Field of Classification Search
CPC ..... H04R 5/033; H04R 5/04; H04S 1/007; H04S 2400/11; H04S 2420/01; H04S 7/304
(Continued)

(56) References Cited

U.S. PATENT DOCUMENTS 6,069,961 A * 5/2000 Nakazawa ..... H04R 3/005 381/122
8,996,296 B2 * 3/2015 Xiang ..... H04S 7/302 701/408
(Continued)

FOREIGN PATENT DOCUMENTS

DE 10 2014 204630 A1 9/2015
EP 2 214 425 A1 8/2010
(Continued)

OTHER PUBLICATIONS

International Search Report and Written Opinion for Application No. PCT/FI2018/050408 dated Aug. 21, 2018, 12 pages.
(Continued)

*Primary Examiner* — Khai N. Nguyen
(74) *Attorney, Agent, or Firm* — Alston & Bird LLP

(57) ABSTRACT

Described herein are an apparatus, a computer program product, and a method for switching between rendering modes based on location data. The method can comprise based on location data indicative of a location of a user in an environment, causing rendering of audio content, via headphones worn by the user, to be switched from a first rendering mode, in which the audio content is rendered such that at least a component of the audio appears to originate from a first location that is fixed relative to the user, to a second rendering mode, in which the audio content is rendered such that at least the component of the audio content appears to originate from a second location that is fixed relative to the environment of the user. The method can
(Continued)

further comprise causing rendering of additional audio content for the user via the headphones.

20 Claims, 10 Drawing Sheets

(51) Int. Cl.

| | |
|---|---|
| ***H04R 1/10*** | (2006.01) |
| ***H04S 7/00*** | (2006.01) |
| ***H04R 5/033*** | (2006.01) |
| ***H04R 5/04*** | (2006.01) |
| ***H04S 1/00*** | (2006.01) |

(52) U.S. Cl.
CPC ..... *H04S 2400/11* (2013.01); *H04S 2420/01* (2013.01)

(58) Field of Classification Search
USPC ..... 381/72, 74, 303, 309, 370
See application file for complete search history.

(56) References Cited

U.S. PATENT DOCUMENTS

| | | | | |
|---|---|---|---|---|
| 9,464,912 | B1 * | 10/2016 | Smus | G01C 21/3629 |
| 9,584,946 | B1 | 2/2017 | Lyren et al. | |
| 9,980,078 | B2 * | 5/2018 | Laaksonen | H04S 7/304 |
| 2013/0272527 | A1 * | 10/2013 | Oomen | H04S 3/004 381/17 |
| 2014/0119581 | A1 * | 5/2014 | Tsingos | H04S 3/008 381/300 |
| 2014/0328505 | A1 * | 11/2014 | Heinemann | G06F 3/017 381/303 |
| 2015/0230040 | A1 * | 8/2015 | Squires | H04S 7/302 381/303 |
| 2018/0035072 | A1 * | 2/2018 | Asarikuniyil | H04N 21/8106 |
| 2018/0109901 | A1 * | 4/2018 | Laaksonen | G06F 3/012 |
| 2020/0068335 | A1 * | 2/2020 | Eronen | H04R 5/04 |

FOREIGN PATENT DOCUMENTS

| | | | |
|---|---|---|---|
| EP | 2 690 407 | A1 | 1/2014 |
| WO | WO 2007/112756 | A2 | 10/2007 |

OTHER PUBLICATIONS

Extended European Search Report for Application No. 17 17 4239 dated Oct. 11, 2017, 9 pages.
Automatic Museum Guide by Locatify [online] [retrieved Nov. 27, 2019]. Retrieved via the Internet: https://locatify.com/automatic-museum-guide/ (undated) 3 pages.
Background Music for Mac Automatically Pauses Your Music When Audio Plays Elsewhere [online][retrieved Nov. 27, 2019]. Retrieved from the Internet: https://lifehacker.com/background-music-for-mac-automatically-pauses-your-musi-1771608712. (dated Apr. 18, 2016) 3 pages.
Theater Mode will auto-silence your phone at the movies—SlashGear [online] [retrieved Nov. 27, 2019]. Retrieved via the Internet: https://www.slashgear.com/theater-mode-will-auto-silence-your-phone-at-the-movies-19365210/ (dated Jan. 19, 2015) 8 pages.
Office Action for European Application No. 17 174 239.8 dated Apr. 29, 2020, 7 pages.

* cited by examiner

SWITCHING RENDERING MODE BASED ON LOCATION DATA

CROSS-REFERENCE TO RELATED APPLICATIONS

This application is a U.S. National Stage Application under 35 U.S.C. § 371 of International Patent Application No. PCT/FI2018/050408, filed May 30, 2018, entitled "Switching Rendering Mode Based on Location Data," which claims priority to and the benefit of European Patent Application No. 17174239.8, filed Jun. 2, 2017, entitled "Switching Rendering Mode Based on Location Data," the entire disclosures of which are hereby incorporated herein by reference in their entireties for all purposes.

FIELD

This specification relates to the rendering of audio content and, more particularly, to switching a rendering mode based on location data.

BACKGROUND

Modern audio rendering devices allow audio content to be rendered for users based on the location of the device or user. As such, in an exhibition space (e.g. a museum or a gallery), particular audio content may be associated with different points of interest (e.g. exhibits) within the space and may be caused to be rendered for the user when it is detected that the user (or their rendering device) is near a particular point of interest. In this way, the user may freely navigate around the exhibition space and may hear relevant audio content based on the particular points of interest in their vicinity.

BRIEF SUMMARY

In a first aspect, this specification describes a method comprising: based on location data indicative of a location of a user in an environment, causing rendering of audio content, via headphones worn by the user, to be switched from a first rendering mode, in which the audio content is rendered such that at least a component of the audio content appears to originate from a first location that is fixed relative to the user, to a second rendering mode, in which the audio content is rendered such that at the least the component of the audio content appears to originate from a second location that is fixed relative to the environment of the user. The second location may be fixed relative to the environment such that the second location remains unchanged even as the location of the user changes. In the first rendering mode, the audio content may be rendered such that the least one component of the audio content appears to originate from a location that is fixed relative to the user.

The rendering of the audio content may be caused to be switched from the first rendering mode to the second rendering mode based on a comparison of the location of the user with a first predetermined reference location in the environment. The method may further comprise, while causing the audio content to be rendered in the second rendering mode and based on a comparison of the location of the user with a second predetermined reference location in the environment, associating the at least one audio component with a new location that is fixed relative to the environment such that the at least one component appears to originate from the new location. Associating the at least one audio component with the new location may be performed in response to a determination that the user is approaching the second predetermined location in the environment. Determining that the user is approaching the second predetermined location in the environment may comprise determining that the user is within a threshold distance of the second predetermined location and/or that the user is closer to the second predetermined location than the first predetermined location.

The method may further comprise causing the rendering of the audio content to be switched from the first rendering mode to the second rendering mode in response to a determination that the user is entering or has entered a pre-defined area. In addition, the method may comprise causing the rendering of the audio content to be switched back from the second rendering mode to the first rendering mode in response to a determination that the user is leaving or has left the pre-defined area. Switching back from the second rendering mode to the first rendering mode may comprise transitioning gradually back to the rendering mode such that the at least one audio component appears to gradually move from the first second location that is fixed relative to the environment to the first location that is fixed relative to the user. The second location that is fixed relative to the environment may be determined based on a location at which the user is entering or has entered the pre-defined area.

In some examples, in the second rendering mode, the audio content may be rendered such that plural components of the audio content each appear to originate from a different first second location that is fixed relative to the environment.

In addition to causing the rendering of the audio content to be switched to the second rendering mode, the method may include causing additional audio content to be rendered for the user via the headphones. The additional audio content may be caused to be rendered such that it appears to originate from a location that coincides with an object or point of interest within the environment of the user.

In a second aspect, this specification describes apparatus configured to cause performance of any method described with reference to the first aspect.

In a third aspect, this specification describes computer-readable code which, when executed by computing apparatus, causes the computing apparatus to perform any method described with reference to the first aspect.

In a fourth aspect, this specification describes apparatus comprising at least one processor, and at least one memory including computer program code, which when executed by the at least one processor, causes the apparatus to: based on location data indicative of a location of a user in an environment, cause rendering of audio content, via headphones worn by the user, to be switched from a first rendering mode to a second rendering mode in which the audio content is rendered such that at least a component of the audio content appears to originate from a first second location that is fixed relative to the environment of the user.

The second location may be fixed relative to the environment such that the second location remains unchanged even as the location of the user changes.

In the first rendering mode, the audio content may be rendered such that the least one component of the audio content appears to originate from a location that is fixed relative to the user.

The computer program code, when executed by the at least one processor, may further cause the apparatus to cause the rendering of the audio content to be switched from the first rendering mode to the second rendering mode based on a comparison of the location of the user with a first predetermined reference location in the environment.

The computer program code, when executed by the at least one processor, may further cause the apparatus, while causing the audio content to be rendered in the second rendering mode and based on a comparison of the location of the user with a second predetermined reference location in the environment, to associate the at least one audio component with a new location that is fixed relative to the environment such that the at least one component appears to originate from the new location.

The at least one audio component may be associated with the new location in response to a determination that the user is approaching the second predetermined location in the environment.

The computer program code, when executed by the at least one processor, may further cause the apparatus to determine that the user is approaching the second predetermined location in the environment in response to a determination that the user is within a threshold distance of the second predetermined location and/or that the user is closer to the second predetermined location than the first predetermined location.

The computer program code, when executed by the at least one processor, may further cause the apparatus to cause the rendering of the audio content to be switched from the first rendering mode to the second rendering mode in response to a determination that the user is entering or has entered a pre-defined area.

The computer program code, when executed by the at least one processor, may further cause the apparatus to cause the rendering of the audio content to be switched back from the second rendering mode to the first rendering mode in response to a determination that the user is leaving or has left the pre-defined area.

Switching back from the second rendering mode to the first rendering mode may comprise transitioning gradually back to the first rendering mode such that the at least one audio component appears to gradually move from the second location that is fixed relative to the environment to a location that is fixed relative to the user.

The second location that is fixed relative to the environment may be determined based on a location at which the user is entering or has entered the pre-defined area.

The computer program code, when executed by the at least one processor, may further cause the apparatus, when operating in the second rendering mode, to render the audio content such that plural components of the audio content each appear to originate from a different second location that is fixed relative to the environment.

The computer program code, when executed by the at least one processor, may further cause the apparatus, in addition to causing the rendering of the audio content to be switched to the second rendering mode, to cause additional audio content to be rendered for the user via the headphones.

The additional audio content may be caused to be rendered such that it appears to originate from a location that coincides with an object or point of interest within the environment of the user.

In a fifth aspect, this specification describes a computer-readable medium having computer-readable code stored thereon, the computer readable code, which executed by at least one processor, causes performance of: based on location data indicative of a location of a user in an environment, causing rendering of audio content, via headphones worn by the user, to be switched from a first rendering mode to a second rendering mode in which the audio content is rendered such that at least a component of the audio content appears to originate from a second location that is fixed relative to the environment of the user. The computer-readable code stored on the medium of the fifth aspect may further cause performance of any of the operations described with reference to the method of the first aspect.

In a sixth aspect, this specification describes apparatus comprising means for causing rendering of audio content, via headphones worn by the user, to be switched from a first rendering mode to a second rendering mode based on location data indicative of a location of a user in an environment, wherein in the second rendering mode the audio content is rendered such that at least a component of the audio content appears to originate from a first second location that is fixed relative to the environment of the user. The apparatus of the sixth aspect may further comprise means for causing performance of any of the operations described with reference to the method of the first aspect.

The apparatuses of any of the second, fourth or sixth aspects may be in the form of a portable user device.

BRIEF DESCRIPTION OF THE FIGURES

For a more complete understanding of the methods, apparatuses and computer-readable instructions described herein, reference is now made to the following description taken in connection with the accompanying Figures, in which.

DETAILED DESCRIPTION

Figure 1A:
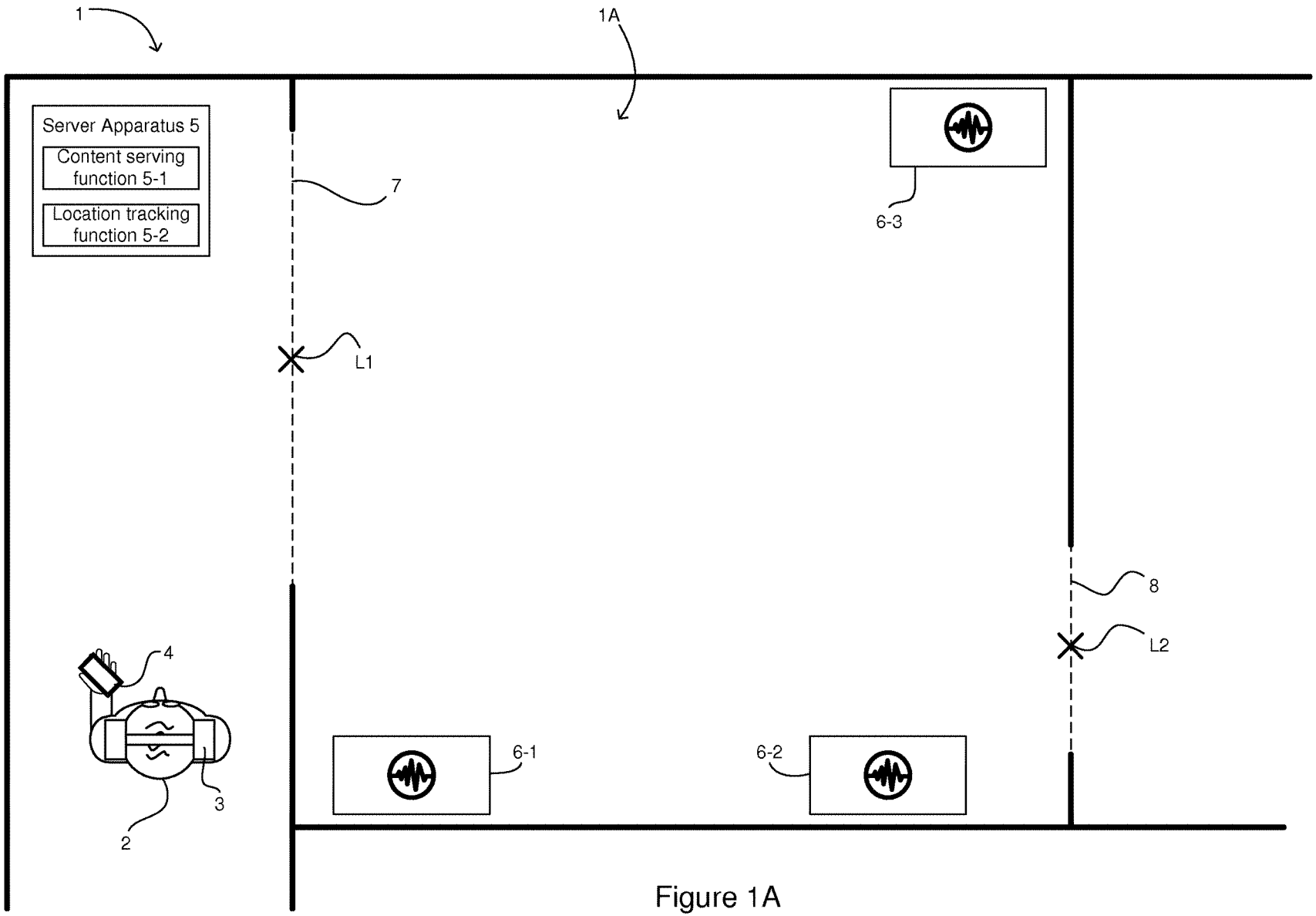
FIGS. 1A to 1H illustrate various functionalities which may be provided by an audio rendering apparatus.

In the description and drawings, like reference numerals may refer to like elements throughout.

FIG. 1A shows an example of an environment 1 in which various functionalities relating to provision of audio content to a user may be performed.

As can be seen from FIG. 1A, a user 2 is located within the environment 1 and is wearing headphones 3, via which audio content can be provided to the user. The audio content may be rendered by audio rendering apparatus 4 associated with the user 2. The audio rendering apparatus 4 may be configured to render audio content that is stored locally on the audio rendering apparatus 4 and/or that is received (such as by streaming) from one or more server. The audio rendering apparatus 4 may be a portable device such as, but not limited to, a mobile phone, a tablet computer, a portable media player or a wearable device such as (but again not limited to) a smart watch. The headphones are stereo headphones which are operable to provide different audio channels to each ear.

A server apparatus 5 (which may be referred to as an audio experience server) may be associated with the environment 1 in such a way that it provides audio content that is associated with the environment 2. For instance, the server apparatus 5 may provide audio content relating to particular points of interest located in the environment 1. The server apparatus 5 may be local to the environment 1, such as illustrated in FIG. 1A, or may be located remotely.

As will be discussed in more detail below, in addition to providing audio content to the audio rendering apparatus 4, the server apparatus 5 may be configured to track the user's position. As such, as illustrated in FIG. 1A, the server apparatus 5 may include an audio content serving function 5-1 as well as a location tracking function 5-2.

Together the audio rendering apparatus 4 and the headphones 3 may be capable of providing directional audio content to the user 2. As such, the audio content may be rendered such that the user 2 may perceive one or more components of the audio content as originating from one more locations around the user. Put another way, the user may perceive components of the audio content as arriving from one or more directions. Provision of the directional audio may be performed using binaural rendering with HRTF (head related transfer function) filtering to position the audio components at the locations about the user. As used herein, the term "headphones" should be understood to encompass earphones, headsets and any other such device for enabling personal consumption of audio content.

The headphones 3 and audio rendering apparatus 4 may also include head tracking functionality for determining the orientation of the user's head. This may be based on one or more movement sensors (not shown) included in the headphones 3 (such as an accelerometer and/or a magnetometer). In other examples, the location tracking function 5-2 (and/or the audio rendering apparatus 4) may estimate the orientation of the user's head based on the user's heading (e.g. based on comparing a series of successive locations of the user).

In FIG. 1A, the environment 1 comprises a pre-defined area 1A. The pre-defined area may be accessed by crossing one or more geo-fences 7, 8. In the example of FIG. 1A, the geo-fences 7, 8 correspond with physical entrances to the pre-defined area 1A, which is otherwise enclosed by a physical boundary (in this specific case, walls). Put another way, in FIG. 1A, the pre-defined area 1A is partially bounded by a series of walls. In other examples, however, the pre-defined area 1A may not be defined by a physical boundary (e.g. walls, fences etc.) but may instead be delimited solely by a geo-fence (or plural geo-fences), defining an area of any suitable shape.

The pre-defined area 1A may be, for instance, an indoor or outdoor area, which includes one or more points (or objects) of interest, e.g. exhibits 6-1, 6-2, 6-3. For instance, the pre-defined area 1A may be an exhibition space. Each of the points of interest (POIs) may be located at a respective different location. Each of the POIs may have associated audio content. For instance, the audio content associated with a particular location may be relevant to the exhibit at that location. The POI/location-associated audio content may be stored on the portable device 4 (e.g. by prior downloading) or may be received at (e.g. streamed to) the portable device 4 from the server apparatus 5. The provision of the audio content from the server apparatus 5 may be performed on an "on-demand" basis, for instance in dependence on the location of the device 4 or its user 2. For reasons which will become apparent, the pre-defined area 1A may be referred to as a 6 degree-of-freedom (6DoF) audio experience area.

The location of the user 2 (or their audio rendering apparatus 4) may be tracked as the user 2 navigates throughout the environment 1. This may be done in any suitable way, for instance via Global Positioning System (GPS), or another positioning method. Such positioning methods may include tag-based methods, in which a radio tag that is co-located with the user 2 (e.g. on their person or integrated in the portable device 4) communicates with installed beacons. Data derived as a result of that communication between the tag and the beacons may then be provided to the location function 5-2 of the server apparatus 5 to allow the location of the user 2 to be tracked. In other examples, fingerprint-based location determination methods, in which the user's position can be determined based on the current Radio Frequency (RF)-fingerprint detected by the audio rendering apparatus 4, may be used.

In some examples, the tracking of the location of the user may be triggered in response to a determination that the user is within an environment 1 which includes an "audio experience area". This determination may be performed in any suitable way. For instance, the determination may be performed using GPS or based on a detection that the audio rendering apparatus 4, headphones or any other device that is co-located with the user is within communications range of a particular wireless transceiver (e.g. a Bluetooth transceiver).

In some implementations, the server apparatus 5 may keep track of the user's location in order to provide audio content that is dependent on the location. In addition or alternatively, the audio rendering apparatus 4 may keep track of its own location (e.g., directly or based on information received from the location tracking function provided by the server apparatus 5).

Figure 1B:
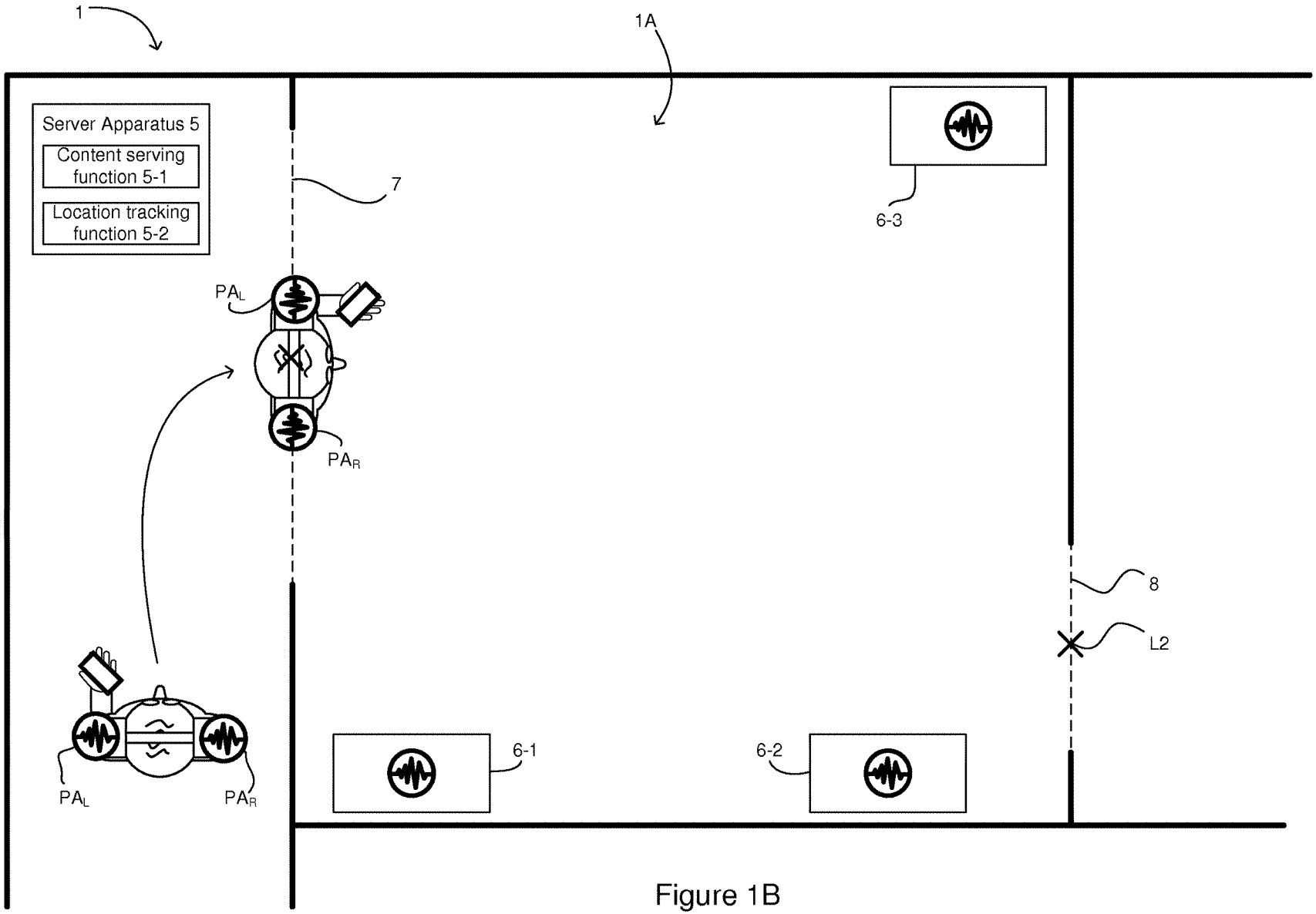

Turning now to FIG. 1B, as can be seen, the user 2 is listening to audio content via their headphones 3. This content may be stored locally on the audio rendering apparatus 4 or may be received at the apparatus 4 from a server. This audio content may be referred to as primary audio content. In the example of FIG. 1A, the primary audio content is stereo content and so includes respective left and right channels (which are labelled $PA_L$ and $PA_R$). In other examples, for instance as illustrated in FIG. 1H, the primary audio content may comprise directional audio content (which may also be referred to as binaural audio content) and so may include one or more audio components $PA_1$, $PA_2$, $PA_3$, $PA_4$ which are rendered so as to appear to originate from locations relative to the user 2.

Regardless of whether the rendered (primary) audio content $PA_L$, $PA_R$ is stereo or directional (or even mono), the audio content is rendered such that its location relative to the user remains constant even as the user navigates the environment 1. It could therefore be said that the audio content remains at a location that is fixed relative to the user 2. For instance, in the case of stereo audio, the left and right channels $PA_L$, $PA_R$ remain within the user's head as the user moves through the environment 1 (the same is also true for mono audio content). This can be seen in FIG. 1B in which the left and right channels $PA_L$, $PA_R$ of the audio content remain with the user as the user moves from a first location to a second location. This mode of rendering, in which the audio content is rendered so as to move with the user, may be referred to as a first (or normal) rendering mode.

Rendering of audio content in the first mode may not always be appropriate. For instance, in areas which have associated (e.g. location-based) audio content, provision of primary audio content using the first mode may prevent or otherwise impair the user's consumption of the associated audio content.

As such, according to certain examples described herein, the audio rendering apparatus 4 is configured to cause the rendering of the primary audio content, via the headphones 3 worn by the user 2, to be switched from the first rendering mode based on location data indicative of the location of the user 2 in the environment 1. More specifically, the apparatus 4 is configured to cause the rendering to switch to a second rendering mode in which the primary audio content is rendered such that at least a component of the primary audio content appears to originate from a first location that is fixed relative to the environment of the user.

In certain examples, the switching from the first rendering mode to the second rendering mode may be caused based on a comparison of the location of the user with a predetermined reference location in the environment. For instance, the reference location (e.g. location L1 in FIGS. 1A and 1B) may correspond to an entrance to a pre-defined area, such as an exhibition space 1A. As such, when it is determined that the user 2 has entered the area, the rendering of the audio content may be switched to the second rendering mode.

As will be appreciated, the reference location might define a geo-fence. For instance, in FIGS. 1A and 1B, the geo-fence 7 might coincide with the reference location L1 and extend across the entrance into the pre-defined area 1A. In other examples, the geo-fence might be defined as a perimeter which is a pre-defined distance from the reference location. In such examples, the pre-defined area may correspond to the area that is encompassed by the geo-fence. Regardless of how the geo-fence is defined, switching from the first rendering mode to the second rendering mode may be caused in response to a determination that the user is crossing or has crossed the geo-fence in a specific direction. Put another way, the switching is caused in response to determining that the user is entering or has entered into the pre-defined area 1A.

The determination as to whether the user has entered the pre-defined area may be performed in any suitable way, which may or may not be the approach by which the user's location is tracked. In examples in which different approaches are used for tracking the user and determining whether the user is in the pre-defined (audio experience) area 1A, the location tracking may be initiated only once it is determined that the user has entered the pre-defined (audio experience) area 1A.

In other examples, in which the same approach is used, the frequency with which the user's location is determined may be increased when it is determined that the user has entered the pre-defined (audio experience) area. Similarly, in addition or alternatively, tracking of the orientation of the user's head, may be initiated only in response to determining that the user has entered the pre-defined (audio experience) area 1A. In such examples, initiating the tracking of the user's head position may be performed in addition to switching to the second rendering mode.

Figure 1C:
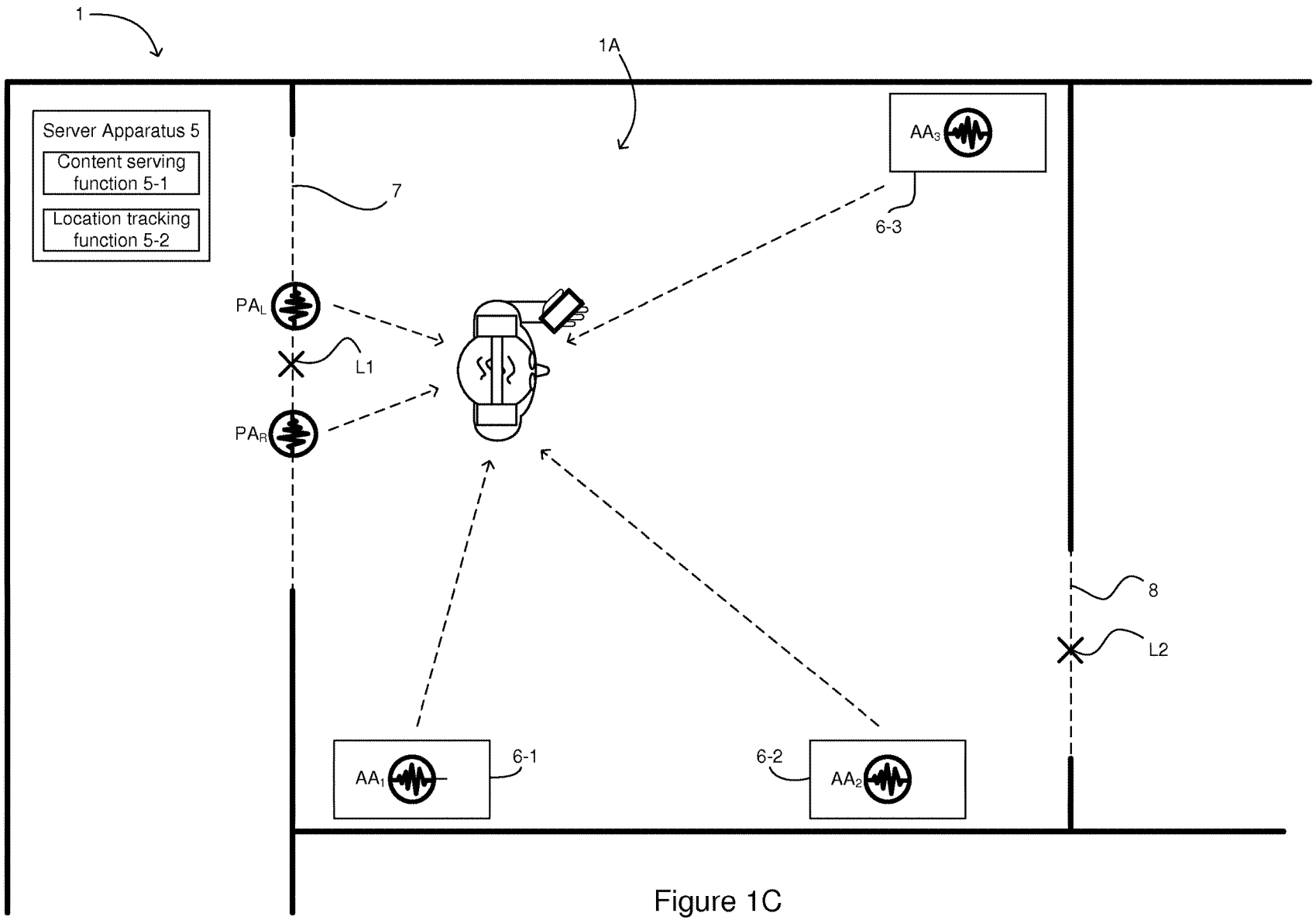

An example of operation in the second rendering mode is illustrated by FIG. 1C in which the left and right channels of the primary audio content $PA_L$, $PA_R$ are rendered so as to appear to originate from respective locations at the entrance to the pre-defined area 1A. As such, when the user enters the pre-defined area 1A, the primary audio content appears to remain (or be left) at entrance to the area even as the user moves further into the pre-defined area. Moreover, the primary audio content appears to remain at the fixed location (s) (relative to the environment) even as the location of the user 2 changes. Thus, as the user walks away from the first, fixed location (which in this example corresponds to the entrance to the pre-defined area 1A), the primary audio content appears to originate from behind the user 2 and may become less loud as the user moves further away from the location at which the content is fixed.

The "first location" that is fixed relative to the environment (that is the location at which the at least one component of the primary audio content is "left" when the user crosses the geo-fence/enters the pre-defined area) may be dependent on the location at which the user crosses the geo-fence/enters the pre-defined area. For instance, the first fixed location may correspond generally to the location at which the user crosses the geo-fence/enters the pre-defined area. In some specific examples, the first location at which an audio component is fixed may correspond to the location at which the audio component coincided with the geo-fence. As such, as can be seen in the example of FIG. 1C, the left and right channels may be fixed at respective first locations at which the user's left and right headphones coincided with the geo-fence as the user crossed into the pre-defined area.

As will of course be appreciated, although the figures depict the components of the primary audio content each being fixed at respective different locations in the environment, in some examples multiple components (e.g. both of the stereo audio components $PA_L$, $PA_R$) may be fixed at a single common location. Similarly, primary audio content that was rendered in the first rendering mode as "mono" content may be fixed at a single location.

Switching from the first rendering mode to the second rendering mode may include performing gradual cross-fading between the first mode rendering (e.g. stereo) and the second mode rendering (binaural rendering). In this way, the audio components may be gradually externalised (i.e. may gradually move from within the user's head to the fixed locations which are external to the user's head).

As mentioned above, by leaving the primary audio content at the entrance to the pre-defined area, the user may be able simultaneously to consume additional content. As such, the audio rendering apparatus 4 may be configured, in addition to causing the rendering of the audio content to be switched to the second rendering mode, to cause additional audio content to be rendered for the user via the headphones 3.

The additional audio content may be associated with an object or point of interest (POI) and may be caused to be rendered such that it appears to originate from the location of the associated object or POI. If the object or POI is static, the associated additional audio may appear to originate from a location that is fixed relative to the environment of the user. If, on the other hand, the object or POI is moving, the associated additional audio content may appear to move with the object or POI. Since the additional audio content is rendered so as to appear to originate from a particular location (e.g. coinciding with one of the exhibits 6-1, 6-2, 6-3), the additional audio content may become louder as the user approaches the POI. The primary audio content, on the other hand, may become quieter (as the user moves away from the first fixed location) and/or may change direction relative to the head of the user, depending on whether the orientation of the user's head changes whilst moving towards the location with which the additional audio content is associated. In this way, the user may be able to consume the additional audio content, whilst still hearing the primary audio content in the background. In addition, by leaving the primary audio content at the point of entry into the pre-defined area, it may act as an intuitive guide to assist the user when navigating back out of the pre-defined area.

The location that is associated with the additional audio content may be pre-stored with the additional audio content at the audio rendering apparatus or may be provided to the audio rendering apparatus 4 along with the additional content from the server apparatus 5.

In some examples, the fixed locations at which the primary audio components are fixed when the user enters the pre-defined area 1A may be pre-determined (or otherwise suggested) by the server apparatus 5. The fixed locations may be selected so as not to coincide/interfere with any of the locations associated with the additional audio content. The fixed locations (whether they are pre-determined or are based on the user's point of entry into the pre-defined area) may be communicated to the audio rendering apparatus 4 from the server apparatus 5 when it is determined that the user has entered the area 1A.

In the example of FIG. 1C, each of the POIs (i.e. exhibits 6-1, 6-2, 6-2) has additional audio content $AA_1$, $AA_2$, $AA_3$ associated with them. The additional audio content corresponding to each of the POIs may be rendered simultaneously, with the volume and direction depending on the location and orientation of the user 2. In other examples, only one piece of additional content may be rendered, for instance, the content corresponding to the nearest POI.

In addition to distance-dependent volume (in which the volume corresponds to the distance between the user and the perceived origin of the audio content), the "direct-to-reverberant ratio" of the audio content may be controlled in order to improve the perception of distance of the audio content (or a component thereof). Specifically, the ratio may be controlled such that the proportion of direct audio content decreases with increasing distance. As will be appreciated, a similar technique may be applied to the one or more components of primary audio content, thereby to improve the perception of distance.

Figure 1D:
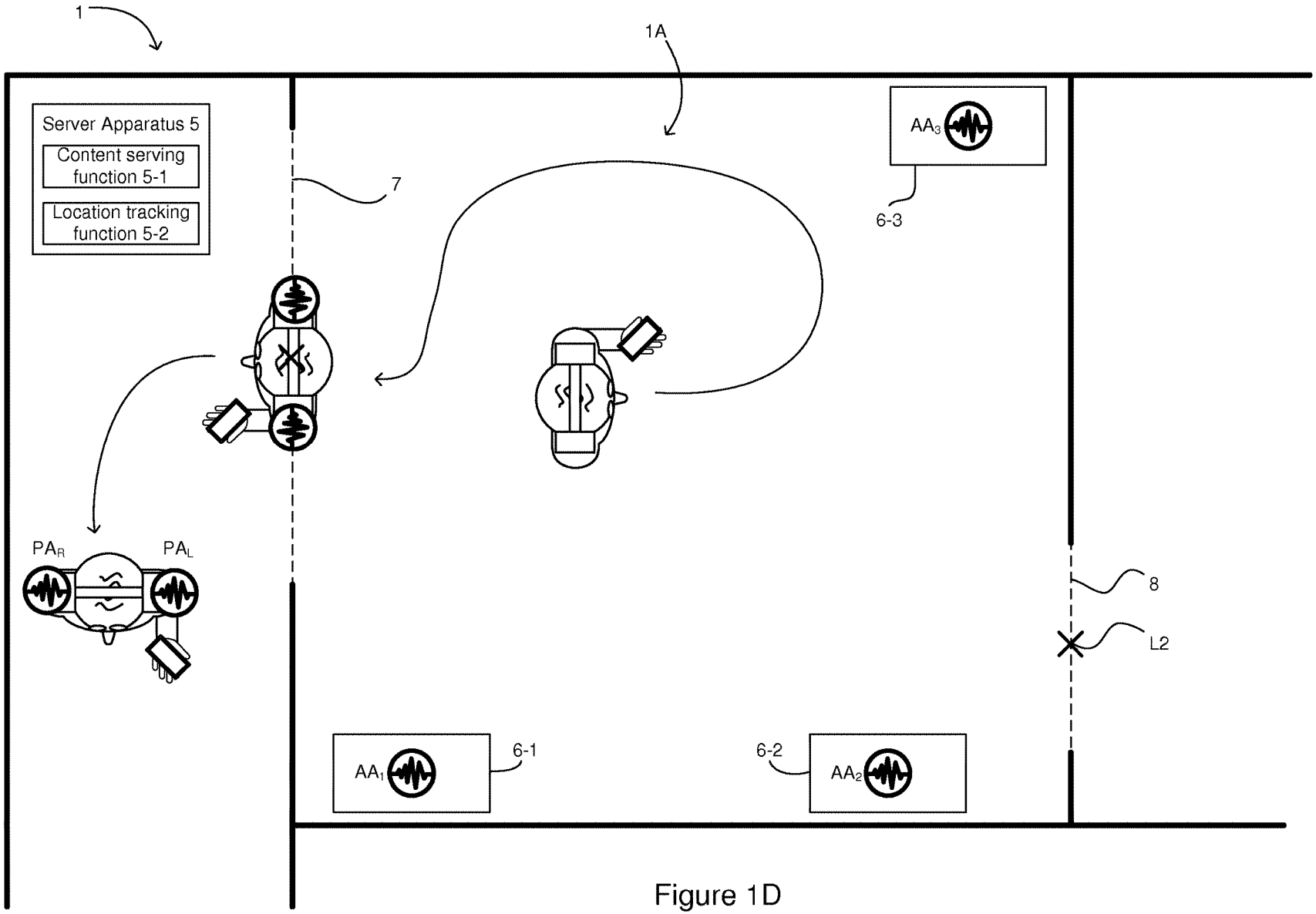

As illustrated in FIG. 1D, if the user 2 is subsequently detected to be crossing, or as having crossed, the geo-fence 7 in a second direction (or as exiting or having exited the pre-defined area), the audio rendering apparatus 4 may cause rendering to switch back to the first rendering mode, in which the components of the primary audio content appear to travel with the user as they move within the environment. As such, when the user re-crosses the geo-fence/leaves the pre-defined area, they appear to seamlessly "pick-up" their audio content. In addition, in some implementations, once the user is outside the pre-defined area, the additional audio content may no longer be rendered for the user. As such, only the primary audio content may be rendered.

Figure 1E:
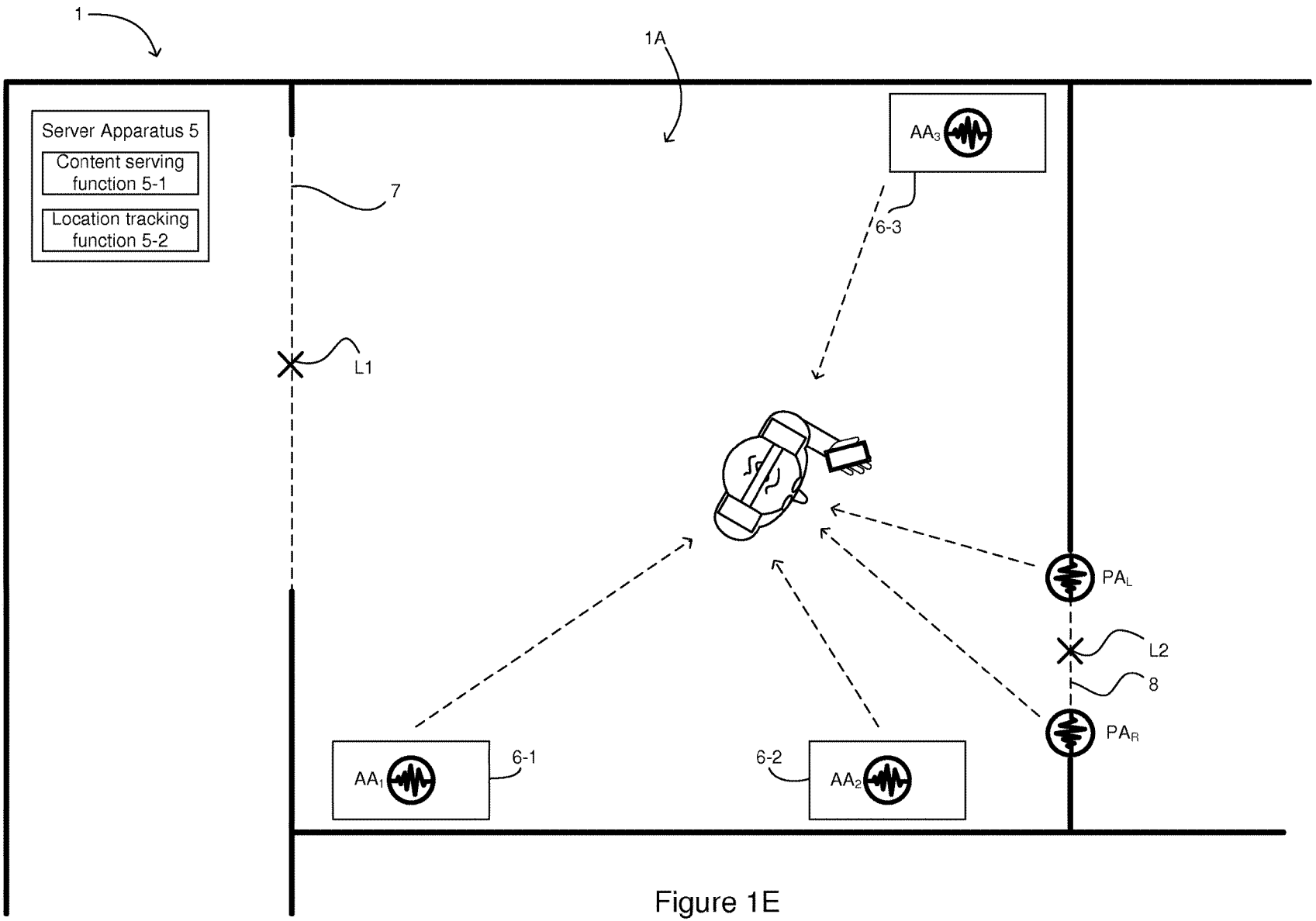

As can be appreciated from FIG. 1E, due to the user facing in the opposite direction when they re-cross the geo-fence, the relative arrangement of the fixed locations of the components of the primary audio content ($PA_L$, $PA_R$) may not correspond to relative arrangement of the left and right headphones via which the components were originally rendered when in the first rendering mode (specifically, they may be reversed). In such instances, the components may be caused to appear to gradually transition back to their original headphone. Alternatively, although potentially less satisfying to the listener, the component may be caused to be rendered by its original headphone in the first rendering mode as soon as the user is detected as re-crossing the geo-fence/leaving the pre-defined area.

Turning now to FIG. 1E, the audio rendering apparatus 4 may, while causing the primary audio content to be rendered in the second rendering mode, associate the at least one audio component with a new location that is fixed relative to the environment such that the at least one component appears to originate from the new location. This operation may be performed based on a comparison of the location of the user with a second predetermined reference location in the environment. For instance, the operation may be performed in response to a determination that the user is approaching the second predetermined location in the environment. It may be determined that the user is approaching the second predetermined location when the user is, for instance, within a threshold distance of the second predetermined location and/or is closer to the second predetermined location than the first predetermined location. In addition to one or both of the above requirements with regard to the location of the user, in order to determine that the user is approaching the second predetermined location, it may also be required that the user is heading in the direction of the second predetermined location.

The second predetermined location may be a location that is different to the first predetermined location L1 and may correspond with a geo-fence. For instance, as illustrated in FIG. 1E, the second pre-determined location L2 may correspond with a second geo-fence 8 that is co-located with another entrance/exit to the pre-defined area.

In examples in which a single geo-fence delimits the pre-defined area, the second pre-determined location may be a different location on that geo-fence.

The new location that is fixed relative to the environment of the user with which the component of the primary audio content is associated may generally correspond with the second pre-determined location L2. For instance, as illustrated in FIG. 1E, the new location of the component of the primary audio content may be on the geo-fence and/or the physical entrance/exit of the pre-defined area.

Figure 1F:
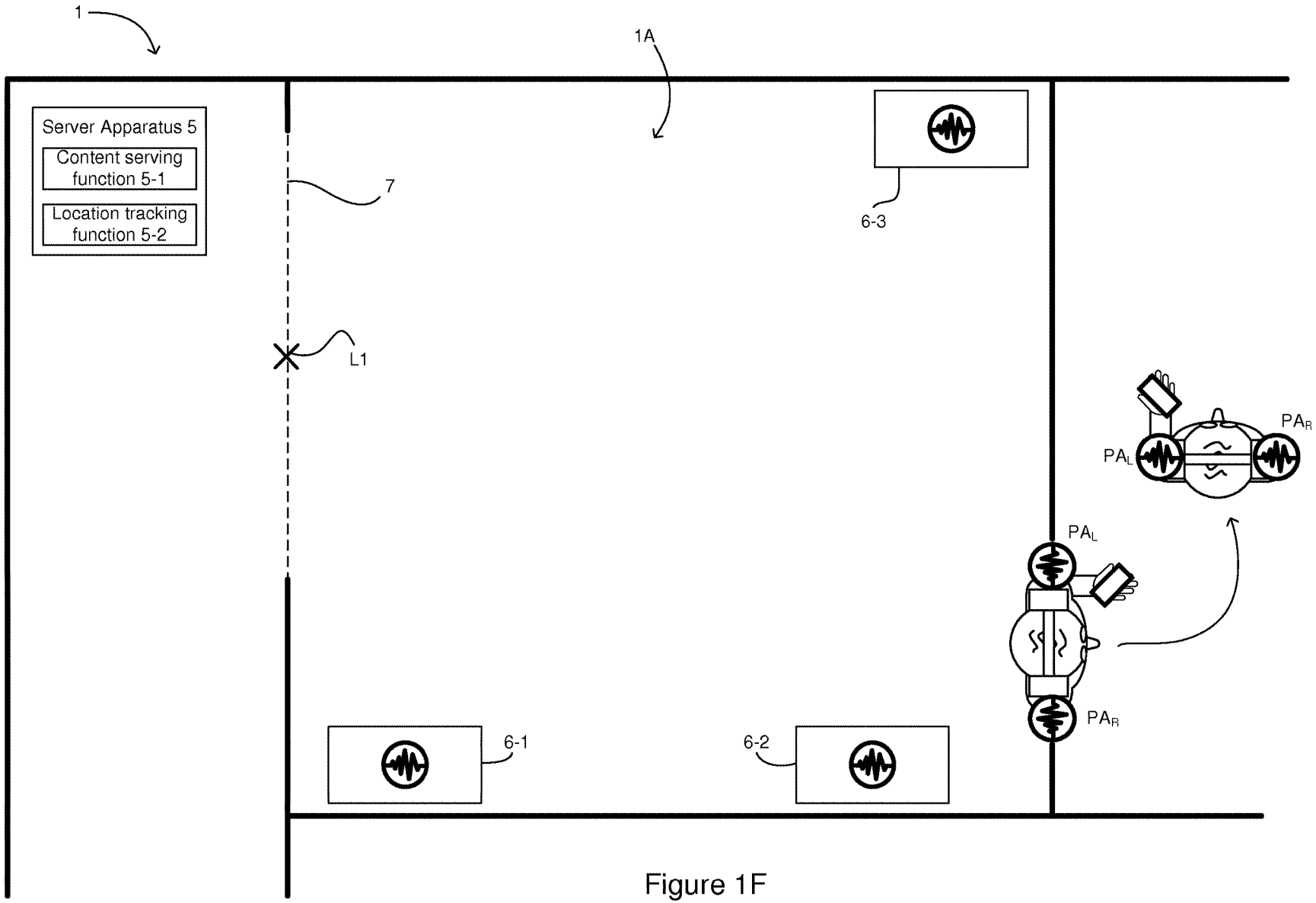

By associating the primary audio content with the new location, the user may be able seamlessly to "pick-up" the primary audio content regardless of the point at which they exit the predefined area. This is illustrated in FIG. 1F.

In some examples, even though user has left a first pre-defined area, the content may continue to be rendered in the second rendering mode and so the user may not "pick up" their audio content. This may occur, for instance, when the user is entering a second pre-defined (audio experience) area in which primary audio should be rendered in the second rendering mode (e.g. another exhibition space).

Figure 1G:
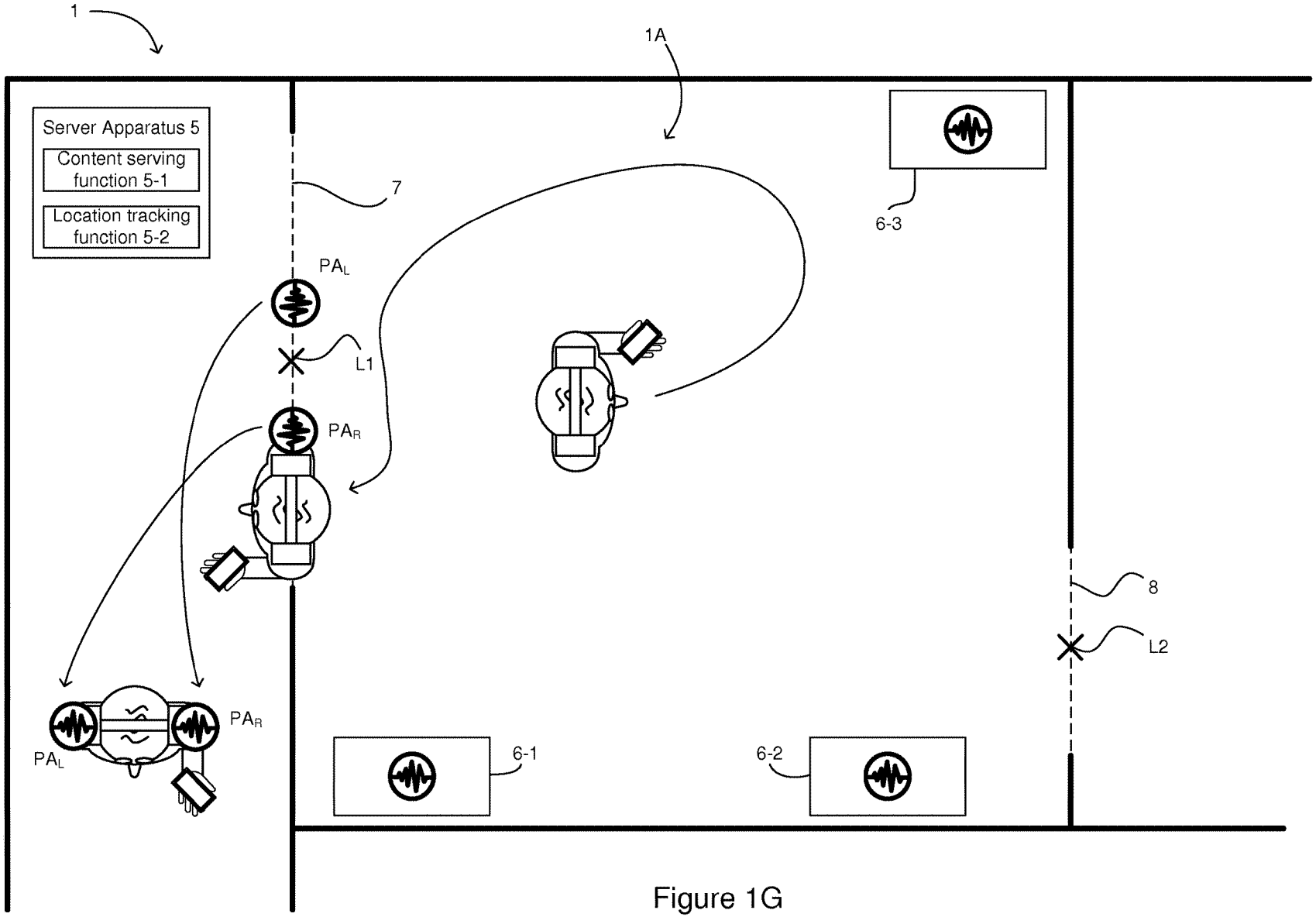
Figure 1H:
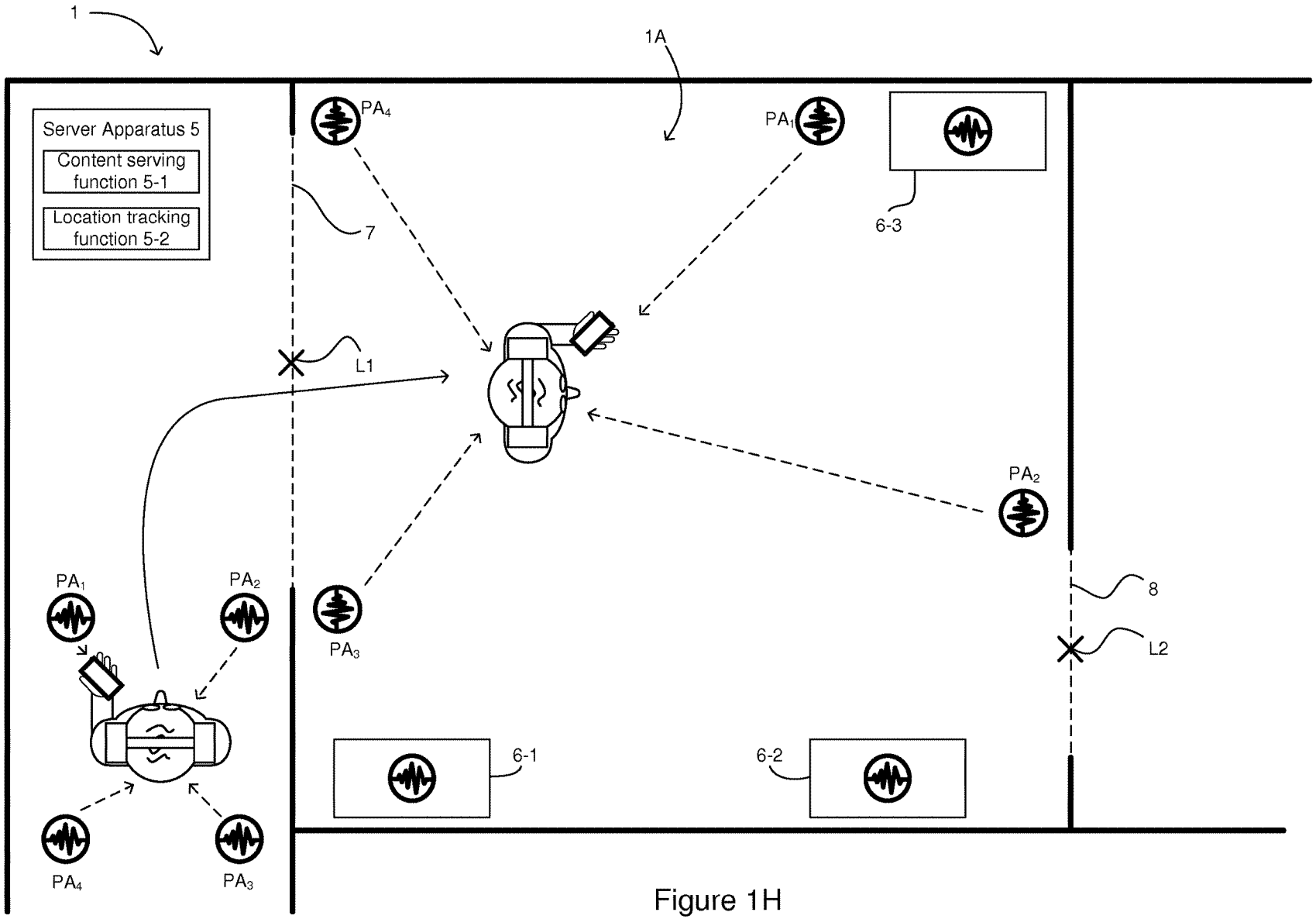

Referring now to FIG. 1G, in some examples, the audio rendering apparatus 4 may be configured to, in response to a determination that the user is crossing or has crossed the first geo-fence in the second direction, transition gradually back to the first rendering mode. As such, the at least one audio component $PA_L$, $PA_R$ may appear to gradually move from the first location that is fixed relative to the environment to a location that is fixed relative to the user (e.g. inside the user's head). This may occur when the user exits the pre-defined area/re-crosses a geo-fence at a location that is different to the location at which audio component is currently fixed. So, in response to a detection that the user has exited/crossed at a location that is different to the first fixed location with which the primary audio content was associated while the user was in the pre-defined area, the audio components of the primary audio content may appear to gradually gravitate back to their original locations, which are fixed relative to the user.

In some examples, and as illustrated in FIG. 1H, the audio rendering apparatus 4 may be configured, when operating in the second rendering mode, to render the audio content such that plural components, $PA_1$, $PA_2$, $PA_3$, $PA_4$ of the audio content each appear to originate from a different first location that is fixed relative to the environment.

In the example of FIG. 1H, the primary audio content is, in the first mode, rendered as directional audio, comprising plural primary components at different locations that are fixed relative to the user. Once the user enters the predefined area, the rendering switches to the second rendering mode and the plural components of primary audio are placed at plural different locations that are fixed relative to the environment. The arrangement of the plural fixed locations may correspond generally to the arrangement of the audio components when being rendered in the first rendering mode. In examples such as that of FIG. 1H, in response to switching to the second rendering mode, the audio components may be caused to gradually move from their respective first mode locations that are fixed relative to the user to their second rendering mode locations that are fixed relative to the environment. Alternatively, the transition may be near-instantaneous.

As discussed previously, in some examples, the fixed locations at which the primary audio components are fixed may be pre-determined (or otherwise suggested) by the server apparatus 5. The fixed locations may thus be communicated to the audio rendering apparatus 4 when it is determined that the user has entered the area (or when it is determined that the user approaching another point of exit from the pre-defined area). The fixed locations may be selected so as not to coincide/interfere with any of the locations associated with the additional audio content.

Although not illustrated in any of FIGS. 1A to 1H, in some examples, different fixed locations may be assigned to different audio components based on the content type of audio component. For instance, speech may be assigned to a first location and the music may be assigned to second location. In such an example, speech components could be caused to be fixed at a central part of a door/geo-fence with music components being fixed to either side.

Figure 2:
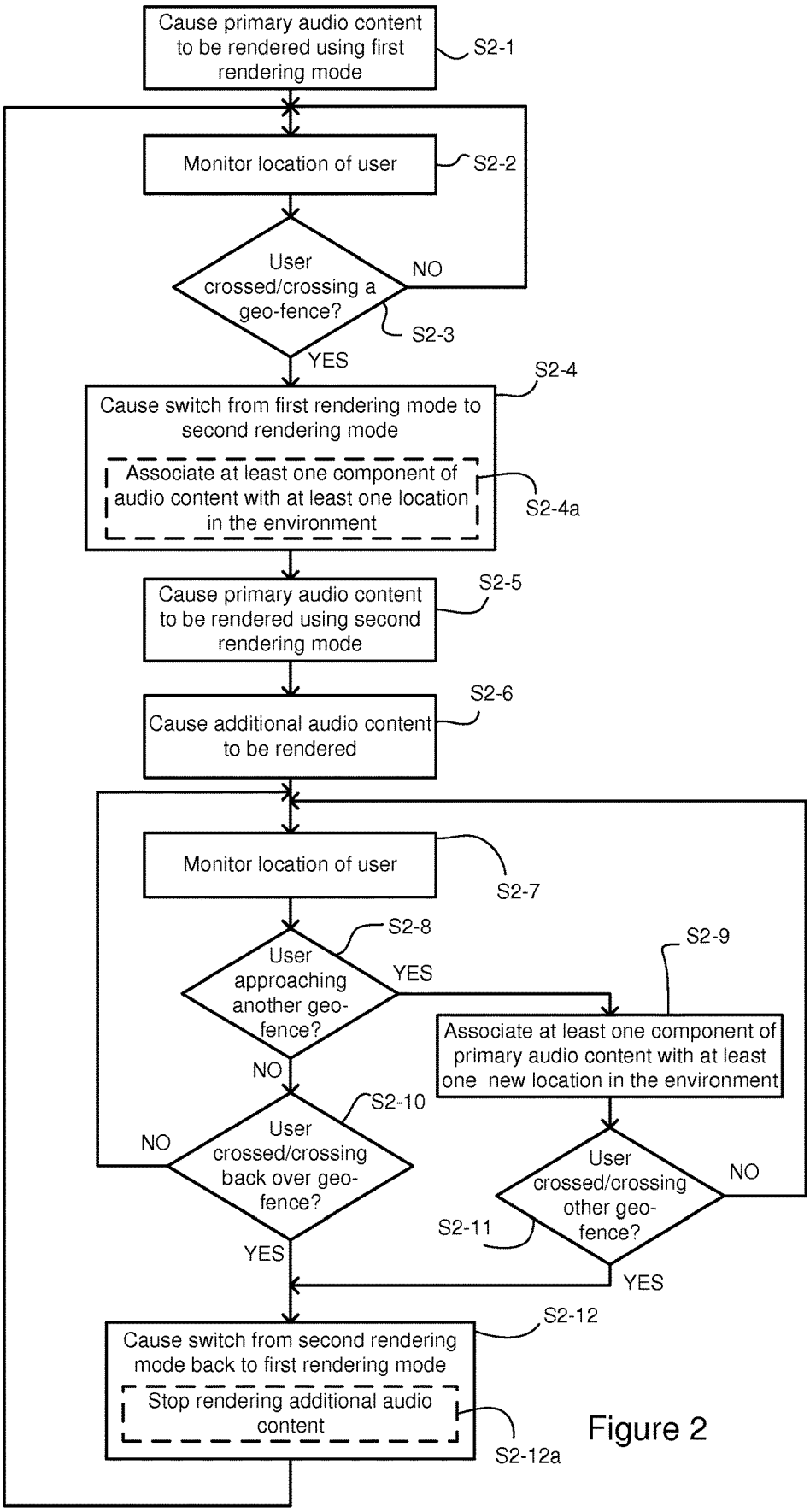
FIG. 2 is a flow chart illustrating various example operations which may be performed by one or more apparatuses to provide the functionalities illustrated by FIGS. 1A to 1H.

FIG. 2 is a flow chart illustrating various example operations which may be performed by one or more apparatuses to provide the functionality illustrated by, and described with reference to, FIGS. 1A to 1H.

In operation S2-1, the audio rendering apparatus 4 causes the primary audio content to be rendered to the user in the first rendering mode. As described above, in the first rendering mode, one or more components of the primary audio content may be rendered so as to appear to be at (or originate from) a location that is fixed relative to the user. Put another way, when operating in the first rendering mode, the rendered audio content appears to travel with the user as they move throughout the environment.

In operation S2-2, the location of the user (or their device) is monitored. In some examples, this may be performed by the audio rendering apparatus 4. In other examples, monitoring of the location of the user, or their device 4, may be performed by a location tracking function 5-2 which may be configured to keep track of users within the environment. For instance, the location tracking function 5-2 may monitor the location of the user based on RF signals received from a device (e.g. a location tag) that is co-located with, or on the person of, the user.

In operation S2-3, it is determined whether the user 3 has crossed or is crossing a geo-fence. Put another way, it is determined whether or not the location of a user satisfies a predetermined criterion with respect to a reference location. Put yet another way, it is determined whether or not the user has entered or is entering a predefined area. Again, this may be performed by the audio rendering apparatus 4 or by the location tracking function 5-2 of the server apparatus 5.

If it is determined that the user is crossing or has crossed a geo-fence (or that the user is entering or has entered the predefined area or that the user's location satisfies the predetermined criterion with respect to the reference location), a positive determination is reached and operation S2-4 is performed. Alternatively, if it is determined that the user has not crossed/is not crossing the geo-fence (or that the user is outside the predefined area/the user's location does not satisfy the predetermined criterion with respect to the reference location) operations S2-2 and S2-3 are repeated.

In operation S2-4, the switch from the first rendering mode to the second rendering mode is caused. As will be appreciated, this may be performed by audio rendering apparatus 4, for instance, when the audio rendering apparatus 4 is monitoring the location. Alternatively, operation S2-4 may be performed by the location tracking function 5-2 by sending a rendering mode switch trigger message to the audio rendering apparatus 4.

As illustrated by operation S2-4*a*, causing the switch from the first rendering mode to the second rendering mode may comprise associating at least one audio component of the primary audio content with at least one first location that is fixed relative to the environment. Associating audio components with locations may include assigning a location to the audio components, with the audio component being rendered so as appear to originate from the assigned location when the component is rendered using the second rendering mode. As discussed above, in some examples, the first fixed location(s) may be determined by the server apparatus 5 and communicated to the audio rendering apparatus 4.

In some examples, in addition to switching to the second rendering mode, initiation of the head position tracking may also be triggered in response to a positive determination in operation S2-3. In addition or alternatively, the frequency with which the user's location is tracked may also be increased.

In operation S2-5, in response to the switch to the second rendering mode being caused, the primary audio content is caused to be rendered using the second rendering mode. As explained above, in the second rendering mode, at least one audio component of the primary audio content is rendered such that it appears to originate from a location that is fixed relative to the environment of the user (and so does not move as the user moves through the environment).

Rendering in the second mode may be performed based on the fixed location(s) associated with the audio content, the location of the user and the user's head position. As such, while the primary audio content is being rendered using the second rendering mode, the location and orientation of the head of the user may continue to be tracked, such that the primary audio components (and additional audio components, if applicable) may be rendered so as to appear to remain at locations that are fixed relative to the environment.

In operation S2-6, the audio rendering apparatus 4 causes additional audio content to be rendered to the user. As discussed previously, this additional content may comprise one or more separate pieces of audio content which may each be associated with a different location within the predefined area. In such examples, the additional audio content may be rendered such that it appears to originate from the location in the predefined area with which it is associated. As such, as a user approaches a particular point of interest associated with the additional audio content, that audio content will become louder relative to the other content also being rendered. As described above, the additional audio content and their associated locations may be stored locally to the audio rendering apparatus 4 or may be received from the server apparatus 5.

In operation S2-7, the audio rendering apparatus 4 or the location tracking function 5-2 continues to monitor the location of the user.

In operation S2-8, it is determined whether the user is approaching a second geo-fence 8 (or a second, different part of the first geo-fence 7). Similarly to as described with reference to operation S2-3, this operation may be described as determining whether or not the location of a user satisfies a predetermined criterion with respect to a second reference location L2. As will be appreciated, in some examples this determination may be based not only on the location of the user, but also the user's heading. As described with reference to operation S2-3, this operation may be performed by the audio rendering apparatus 4 or a location tracking function 5-2.

If a positive determination is reached in operation S2-8 (i.e. it is determined that the user is approaching another geo-fence or reference location), operation S2-9 may be performed. Alternatively, if a negative determination is reached, operation S2-10 may be performed.

In operation S2-9, in response to determining that the user is approaching another geo-fence 8 or predetermined location L2 (or is approaching another point of exit from the pre-defined area), the at least one audio component of the primary audio content is associated with a new fixed location within the environment. As was discussed with reference to FIG. 1E, this may include reassigning the audio components from their first, fixed locations to second, fixed locations, which may be determined based on location L2 at which the user is likely to exit the predefined area. As such, when a user enters the predefined area, the audio components of the primary audio content may initially be "left" at locations near to the location (e.g. a door), at which the user entered the predefined area. Subsequently, in response to determining that the user is likely to be exiting the predefined area via another location, the audio components may be reassigned to locations near to the location at which the user is likely to exiting.

Subsequent to operation S2-9, it is determined (in operation S2-11) whether the user has crossed or is crossing the other geo-fence 8 (or has left the predefined area at the second location).

In response to a positive determination in operation S2-11 (i.e. that the user has crossed or is crossing the other geo-fence 8/has left the predefined area), the audio rendering apparatus 4 is caused (in operation S2-12) to switch from the second rendering mode back to the first rendering mode. As such, the audio components of the primary audio content are reassigned to locations that are fixed relative to the user. In this way, when the user exits the predefined area at the other location/geo-fence, they are able to seamlessly "pick-up" their primary audio content. As discussed previously, the triggering of the switching of the audio rendering mode may be performed by the audio rendering apparatus 4 or by a location tracking function 5-2 sending a trigger signal to the audio rendering apparatus 4.

As illustrated in FIG. 2, switching back to the first rendering mode in operation S2-12 may also result in the rendering of the additional audio content being stopped (operation S2-12*a*). In addition, head tracking may be stopped and/or the frequency with which the user's location is tracked may be reduced. Subsequent to switching back to the first rendering mode, operation S2-1 may be performed.

As described with reference to FIG. 1G, in the event that the user leaves the predefined area at a location that is different to the location at which the audio component of the primary audio content is fixed, the audio component may be caused to gradually move back towards its location relative to the user. Thus, when the user leaves the predefined area, the audio components of the primary audio content may appear to gravitate back towards the user.

In response to a negative determination in operation S2-11 (i.e. that the user has not crossed or is not crossing the other geo-fence 8/has not left the predefined area), the method returns to operation S2-7 in which the location of the user continues to be monitored.

Returning now to operation S2-8, if it is determined that the user is not approaching another geo-fence 8/reference location L2, operation S2-10 may be performed. In operation S2-10, it is determined whether the user has crossed or is crossing back over the first geo-fence (via which they originally entered the predefined area). This operation may be substantially as described with reference to operation S2-3, except that the geo-fence 7 is being crossed in an opposite direction.

In response to negative determination in operation S2-10 (e.g. that the user has not crossed back over the first geo-fence 7), the method may return to operation S2-7 in which the location of the user is monitored. In response to a positive determination in operation S2-10 (e.g. that the user has crossed or is crossing back over the geo-fence 7), operation S2-12 may be performed in which the switching back to the first rendering mode is caused.

Figure 3:
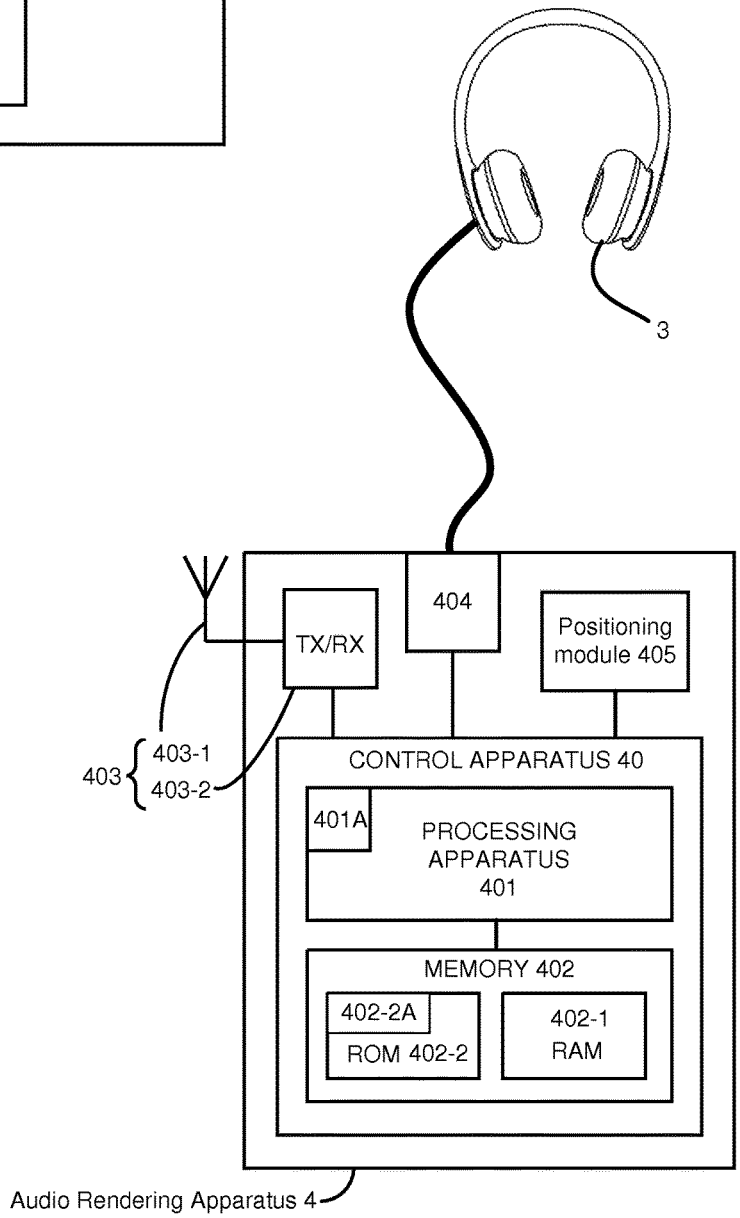
FIG. 3 is a schematic illustration of an example configuration of audio content rendering apparatus which may be utilised to provide the functionalities described with reference to FIGS. 1A to 1H and FIG. 2.

FIG. 3 is a schematic illustration of an example configuration of the audio rendering apparatus 4 described with reference to FIGS. 1A to 1H and FIG. 2.

The audio rendering apparatus 4 comprises a control apparatus 40 which is configured to perform various operations and functions described herein with reference to the audio rendering apparatus 4. The control apparatus 40 may further be configured to control other components of the apparatus 4.

The control apparatus 40 comprises processing apparatus/circuitry 401 and memory 402. The memory 402 may include computer-readable instructions/code 402-2A, which when executed by the processing apparatus 401 causes performance of various ones of the operations described herein. The memory 402 may further store audio content files (e.g., the primary content) for rendering to the user. The audio content files may be stored "permanently" (e.g. until the user decides to delete them), or may be stored "temporarily" (e.g. while the audio content is being streamed from server apparatus and rendered to the user).

The audio rendering apparatus 4 may include a physical or wireless (e.g. Bluetooth) interface 404 for enabling connection with the headphones 3, via which the audio content (both primary and additional) may be provided to the user. In examples in which the headphones 3 include head tracking functionality, data indicative of the orientation of the user's head may be received by the control apparatus 40 from the headphones via the interface 404.

The audio rendering apparatus 4 may further include at least one wireless communication interface 403 for enabling transmission and receipt of wireless signals. For instance, the at least one communication interface 403 may be utilised to receive audio content from a server apparatus 5. The at least one wireless communication interface 403 may also be utilised in determining the location of the user. For instance, it may be used to transmit/receive positioning packets to/from beacons within the environment, thereby enabling the location of the user to be determined. As illustrated in FIG. 3, the wireless communication interface may include an antenna part 403-1 and a transceiver part 403-2.

In some examples, the audio rendering apparatus 4 may further include a positioning module 405, which is configured to determine the location of the device 4. This may be based on any global navigation system (e.g., GPS or GLONASS) or based on signals detected/received via the wireless communication interface 403.

As will be appreciated, each of the wireless communication interface 403, the headphone interface 404 and the positioning module 405 may provide data to and receive data and instructions from the control apparatus 40.

It will also be understood that the audio rendering apparatus 4 may further include one or more other components depending on the nature of the apparatus. For instance, in examples in which the audio rendering apparatus 4 is in the form of a device configured for human interaction (e.g. but not limited to a smart phone, a tablet computer, a smart watch, a media player), the device 4 may include an output interface (e.g. a display) for enabling output of information to the user, and a user input interface for receiving inputs from the user.

Figure 4:
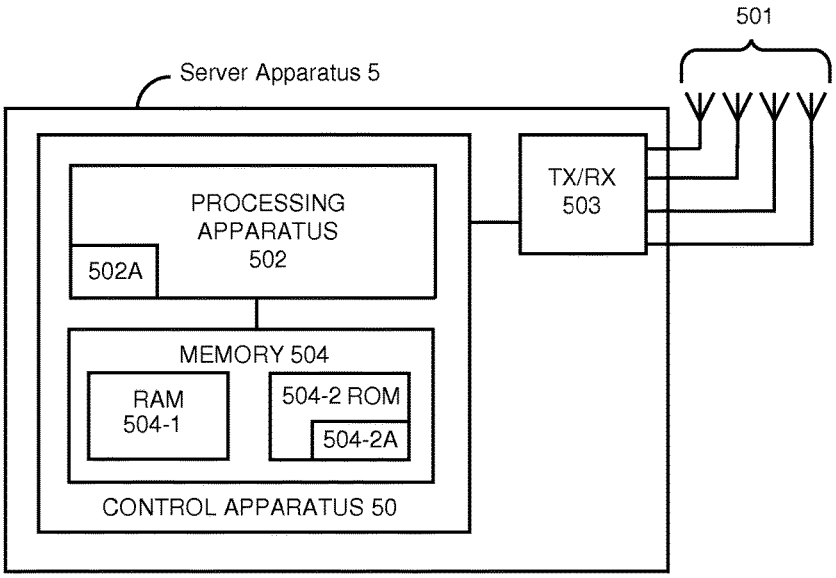
FIG. 4 is a schematic illustration of an example configuration of a server apparatus which may be utilised to provide the functionalities described with reference to FIGS. 1A to 1H and FIG. 2.

FIG. 4 is a schematic illustration of an example configuration of server apparatus 5 for providing audio content and/or for determining the location of the user.

The server apparatus 5 comprises control apparatus 50, which is configured to cause performance of the operations described herein with reference to the server apparatus 5. Similarly to the control apparatus 40 of the audio rendering apparatus 4, the control apparatus 50 of the server apparatus 5 comprises processing apparatus/circuitry 502 and memory 504. Computer readable instructions/code 504-2A may be stored in memory 504. In examples in which the server apparatus 5 provides audio content to the audio rendering apparatus 4, the audio content may be stored in the memory 504.

The server apparatus 5, which may include one or more discrete servers and other functional components and which may be distributed over various locations within the environment and/or remotely, may also include at least one wireless communication interface 501, 503 for communicating with the audio rendering apparatus 4. This may include a transceiver part 503 and an antenna part 501. As illustrated, the antenna part 501 may include an antenna array 501, for instance, when the server apparatus 5 by includes a positioning beacon for receiving/transmitting positioning packets from/to the audio rendering apparatus 4.

The processing apparatus/circuitry 401, 502 described above with reference to FIGS. 3 and 4, which may be termed processing means or computer apparatus, may be of any suitable composition and may include one or more processors, 401A, 502A of any suitable type or suitable combination of types. For example, the processing apparatus/circuitry 401, 502 may be a programmable processor that interprets computer program instructions and processes data. The processing apparatus/circuitry 401, 502 may include plural programmable processors. Alternatively, the processing circuitry 401, 502 may be, for example, programmable hardware with embedded firmware. The processing circuitry 401, 502 may alternatively or additionally include one or more Application Specific Integrated Circuits (ASICs).

The processing apparatus/circuitry 401, 502 described with reference to FIGS. 3 and 4 is coupled to the memory 402, 504 (or one or more storage devices) and is operable to read/write data to/from the memory 402, 504. The memory may comprise a single memory unit or a plurality of memory units upon which the computer-readable instructions (or code) 402-2A, 504-2A is stored. For example, the memory 402, 504 may comprise both volatile memory 402-1, 504-1 and non-volatile memory 402-2, 504-2. For example, the computer readable instructions 402-2A, 504-2A may be stored in the non-volatile memory 402-2, 504-2 and may be executed by the processing apparatus/circuitry 401, 502 using the volatile memory 402-2, 504-2 for temporary storage of data or data and instructions. Examples of volatile memory include RAM, DRAM, and SDRAM etc. Examples of non-volatile memory include ROM, PROM, EEPROM, flash memory, optical storage, magnetic storage, etc. The memories 30 in general may be referred to as non-transitory computer readable memory media.

The term 'memory', in addition to covering memory comprising both non-volatile memory and volatile memory, may also cover one or more volatile memories only, one or more non-volatile memories only, or one or more volatile memories and one or more non-volatile memories.

Figure 5:
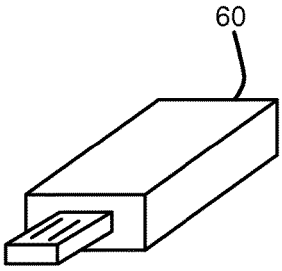
FIG. 5 is a computer readable memory device upon which computer readable instructions may be stored.

The computer readable instructions 402-2A, 504-2A described herein with reference to FIGS. 3 and 4 may be pre-programmed into the control apparatus 40, 50. Alternatively, the computer readable instructions 402-2A, 504-2A may arrive at the control apparatuses 40, 50 via an electromagnetic carrier signal or may be copied from a physical entity such as a computer program product, a memory device or a record medium. An example of such a memory device 60 is illustrated in FIG. 5. The computer readable instructions 402-2A, 504-2A may provide the logic and routines that enable the control apparatuses 40, 50 to perform the functionalities described above. The combination of computer-readable instructions stored on memory (of any of the types described above) may be referred to as a computer program product.

Where applicable, wireless communication capability of the audio rendering apparatus 4 and the server apparatus 5 may be provided by a single integrated circuit. It may alternatively be provided by a set of integrated circuits (i.e. a chipset). The wireless communication capability may alternatively be provided by a hardwired, application-specific integrated circuit (ASIC). Communication between the apparatuses/devices may be provided using any suitable protocol, including but not limited to a Bluetooth protocol (for instance, in accordance or backwards compatible with Bluetooth Core Specification Version 4.2) or an IEEE 802.11 protocol such as WiFi.

As will be appreciated, the apparatuses 4, 5 described herein may include various hardware components which may have not been shown in the Figures since they may not have direct interaction with embodiments of the invention.

Embodiments of the present invention may be implemented in software, hardware, application logic or a combination of software, hardware and application logic. The software, application logic and/or hardware may reside on memory, or any computer media. In an example embodiment, the application logic, software or an instruction set is maintained on any one of various conventional computer-readable media. In the context of this document, a "memory" or "computer-readable medium" may be any non-transitory media or means that can contain, store, communicate, propagate or transport the instructions for use by or in connection with an instruction execution system, apparatus, or device, such as a computer.

Reference to, where relevant, "computer-readable storage medium", "computer program product", "tangibly embodied computer program" etc., or a "processor" or "processing circuitry" etc. should be understood to encompass not only computers having differing architectures such as single/multi-processor architectures and sequencers/parallel architectures, but also specialised circuits such as field programmable gate arrays FPGA, application specific circuits ASIC, signal processing devices and other devices. References to computer program, instructions, code etc. should be understood to express software for a programmable processor firmware such as the programmable content of a hardware device as instructions for a processor or configured or configuration settings for a fixed function device, gate array, programmable logic device, etc.

As used in this application, the term 'circuitry' refers to all of the following: (a) hardware-only circuit implementations (such as implementations in only analogue and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

If desired, the different functions discussed herein may be performed in a different order and/or concurrently with each other. Furthermore, if desired, one or more of the above-described functions may be optional or may be combined. Similarly, it will also be appreciated that the flow diagram of FIG. 2 is an example only and that various operations depicted therein may be omitted, reordered and/or combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes various examples, these descriptions should not be viewed in a limiting sense. Rather, there are several variations and modifications which may be made without departing from the scope of the present invention as defined in the appended claims.

The invention claimed is:

1. A method comprising:

based on location data indicative of a location of a user in an environment, causing rendering of audio content, via headphones worn by the user, to be switched from a first rendering mode to a second rendering mode, wherein, in the first rendering mode, the audio content is rendered such that at least a component of the audio content appears to originate from a first location that is fixed relative to the user, and wherein, in the second rendering mode, the audio content is rendered such that at least the component of the audio content appears to originate from a second location that is fixed relative to the environment of the user; and causing rendering of additional audio content for the user via the headphones.

2. The method of claim 1, further comprising:

causing the rendering of the audio content to be switched from the first rendering mode to the second rendering mode based on a comparison of the location of the user with a first predetermined reference location in the environment.

3. The method of claim 2, further comprising:

while causing the audio content to be rendered in the second rendering mode, based on a comparison of the location of the user with a second predetermined reference location in the environment, associating the at least one audio component with a new location that is fixed relative to the environment such that the at least one component appears to originate from the new location.

4. The method of claim 3, further comprising:

associating the at least one audio component with the new location in response to a determination that the user is approaching the second predetermined location in the environment.

5. The method of claim 4, wherein determining that the user is approaching the second predetermined location in the environment comprises determining that the user is within a threshold distance of the second predetermined location and/or that the user is closer to the second predetermined location than the first predetermined location.

6. The method of claim 1, further comprising:

causing the rendering of the audio content to be switched from the first rendering mode to the second rendering mode in response to a determination that the user is entering or has entered a pre-defined area.

7. The method of claim 6, further comprising:

causing the rendering of the audio content to be switched back from the second rendering mode to the first rendering mode in response to a determination that the user is leaving or has left the pre-defined area.

8. The method of claim 7, wherein switching back from the second rendering mode to the first rendering mode comprises:

transitioning gradually back to the first rendering mode such that the at least one audio component appears to gradually move from the second location that is fixed relative to the environment to the first location that is fixed relative to the user.

9. The method of claim 6, wherein the second location that is fixed relative to the environment is determined based on a location at which the user is entering or has entered the pre-defined area.

10. The method of claim 1, wherein, in the second rendering mode, the audio content is rendered such that two or more portions of a plurality of components of the audio content appear to originate from different locations that are fixed relative to the environment.

11. The method of claim 1, wherein the additional audio content is caused to be rendered such that it appears to originate from a location that coincides with an object or point of interest within the environment of the user.

12. An apparatus comprising at least one processor and at least one memory storing computer program code, wherein the at least one memory and stored computer program code are configured, with the at least one processor, to cause the apparatus to at least:

based on location data indicative of a location of a user in an environment, cause rendering of audio content, via headphones worn by the user, to be switched from a first rendering mode to a second rendering mode, wherein, in the first rendering mode, the audio content is rendered such that at least a component of the audio content appears to originate from a first location that is fixed relative to the user, and wherein, in the second rendering mode, the audio content is rendered such that at least the component of the audio content appears to originate from a second location that is fixed relative to the environment of the user; and cause rendering of additional audio content for the user via the headphones.

13. The apparatus of claim 12, wherein the at least one memory and stored computer program code are configured, with the at least one processor, to further cause the apparatus to:

cause the rendering of the audio content to be switched from the first rendering mode to the second rendering mode based on a comparison of the location of the user with a first predetermined reference location in the environment.

14. The apparatus of claim 13, wherein the at least one memory and stored computer program code are configured, with the at least one processor, to further cause the apparatus to:

while causing the audio content to be rendered in the second rendering mode, based on a comparison of the location of the user with a second predetermined reference location in the environment, associate the at least one audio component with a new location that is fixed relative to the environment such that the at least one component appears to originate from the new location.

15. The apparatus of claim 14, wherein the at least one memory and stored computer program code are configured, with the at least one processor, to further cause the apparatus to:

associate the at least one audio component with the new location in response to a determination that the user is approaching the second predetermined location in the environment.

16. The apparatus of claim 15, wherein determining that the user is approaching the second predetermined location in the environment comprises determining that the user is within a threshold distance of the second predetermined location and/or that the user is closer to the second predetermined location than the first predetermined location.

17. The apparatus of claim 12, wherein the at least one memory and stored computer program code are configured, with the at least one processor, to further cause the apparatus to:

cause the rendering of the audio content to be switched from the first rendering mode to the second rendering mode in response to a determination that the user is entering or has entered a pre-defined area.

18. The apparatus of claim 17, wherein the at least one memory and stored computer program code are configured, with the at least one processor, to further cause the apparatus to:

cause the rendering of the audio content to be switched back from the second rendering mode to the first rendering mode in response to a determination that the user is leaving or has left the pre-defined area.

19. The apparatus of claim 18, wherein switching back from the second rendering mode to the first rendering mode comprises:

transition gradually back to the first rendering mode such that the at least one audio component appears to gradually move from the second location that is fixed relative to the environment to the first location that is fixed relative to the user.

20. A computer program product comprising at least one non-transitory computer-readable storage medium having computer-readable program instructions stored therein, the computer-readable program instructions configured to at least:

based on location data indicative of a location of a user in an environment, cause rendering of audio content, via headphones worn by the user, to be switched from a first rendering mode to a second rendering mode, wherein, in the first rendering mode, the audio content is rendered such that at least a component of the audio content appears to originate from a first location that is fixed relative to the user, and wherein, in the second rendering mode, the audio content is rendered such that at least the component of the audio content appears to originate from a second location that is fixed relative to the environment of the user; and cause rendering of additional audio content for the user via the headphones.

* * * * *